US008529209B2

(12) United States Patent
Belmonte et al.

(10) Patent No.: US 8,529,209 B2
(45) Date of Patent: Sep. 10, 2013

(54) SPACER INTERPOSED BETWEEN A BLADE ROOT AND THE BOTTOM OF A SLOT IN THE DISK IN WHICH THE BLADE IS MOUNTED

(75) Inventors: Olivier Belmonte, Savigny le Temple (FR); Jean-Luc Christian Yvon Goga, Champagne sur Seine (FR); Jean-Noël Mahieu, Paris (FR)

(73) Assignee: SNECMA, Paris (FR)

( * ) Notice: Subject to any disclaimer, the term of this patent is extended or adjusted under 35 U.S.C. 154(b) by 918 days.

(21) Appl. No.: 12/144,974

(22) Filed: Jun. 24, 2008

(65) Prior Publication Data

US 2009/0004017 A1 Jan. 1, 2009

(30) Foreign Application Priority Data

Jun. 26, 2007 (FR) ..... 07 56015

(51) Int. Cl.
*F01D 5/30* (2006.01)

(52) U.S. Cl.
USPC ..... 416/221; 416/248

(58) Field of Classification Search
USPC ..... 416/221, 248
See application file for complete search history.

(56) References Cited

U.S. PATENT DOCUMENTS

| | | | | |
|---|---|---|---|---|
| 5,519,677 | A * | 5/1996 | Shibata et al. | 369/44.16 |
| 5,584,659 | A * | 12/1996 | Schmidt | 416/221 |
| 2005/0207892 | A1 * | 9/2005 | Kanebako et al. | 416/219 R |
| 2006/0275132 | A1 * | 12/2006 | McMillan | 416/224 |

FOREIGN PATENT DOCUMENTS

| | | | |
|---|---|---|---|
| DE | 10 2005 008 509 | A1 | 9/2005 |
| EP | 0 699 824 | A1 | 3/1996 |
| EP | 1 138 879 | A1 | 10/2001 |
| EP | 1 693 551 | A1 | 8/2006 |
| FR | 2 841 609 | | 1/2004 |
| JP | 4-119392 | U | 10/1992 |

* cited by examiner

*Primary Examiner* — Zandra Smith
*Assistant Examiner* — Jamie C Niesz
(74) *Attorney, Agent, or Firm* — Oblon, Spivak, McClelland, Maier & Neustadt, L.L.P.

(57) ABSTRACT

Spacers interposed between blades attached to the disk of a rotor having slots and bottoms of the slots are disclosed. Each spacer is made of an elastically deformable material and at least one longitudinal segment of the spacer presents a transverse profile of arcuate shape to define two lateral contact zones.

2 Claims, 1 Drawing Sheet

FIG.1
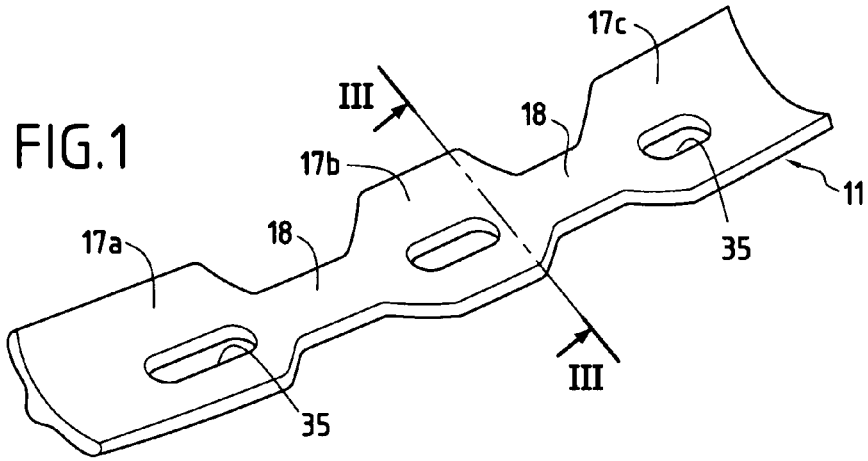
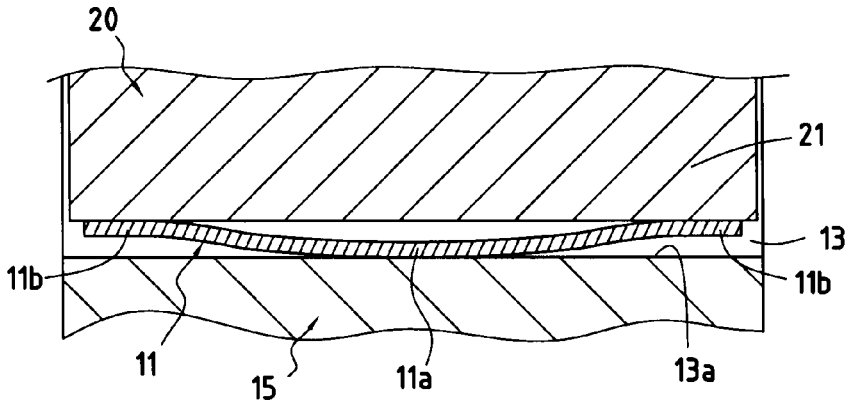
FIG.2
FIG.3
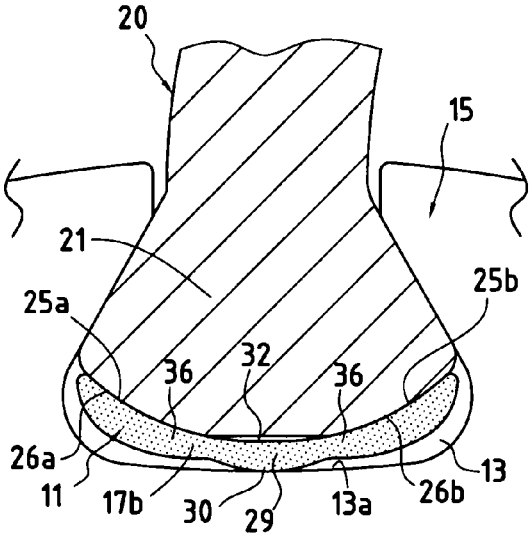
FIG.4
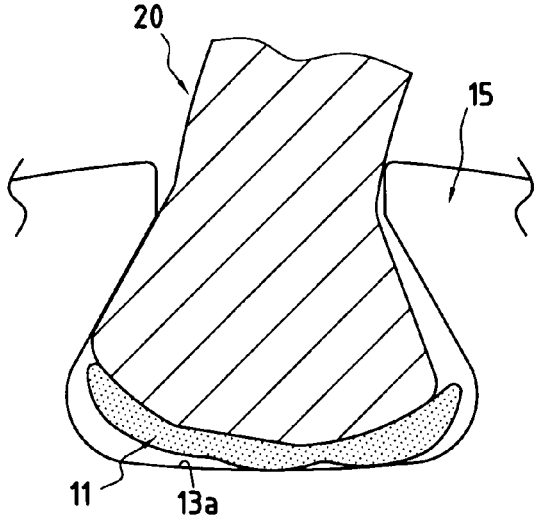

SPACER INTERPOSED BETWEEN A BLADE ROOT AND THE BOTTOM OF A SLOT IN THE DISK IN WHICH THE BLADE IS MOUNTED

BACKGROUND OF THE INVENTION

The invention relates in general to a turbomachine rotor, and more particularly to a fan rotor comprising a disk with slots in its periphery and respective blades attached to said rotor, each blade having a blade root engaged in a corresponding slot. The invention relates to an improvement of an elongate spacer that is interposed between the blade root and the bottom of the slot. The invention applies particularly to mounting blades made of 3D-woven composite material, of the kind that are being used more and more in fans. The invention relates to a spacer that is well adapted to this type of blade (although not exclusively so), the spacer itself possibly being made of a material that is the same or similar. One of the objects of the invention is to improve the behavior of the blades of a rotor, in particular a fan rotor, in the event of a serious incident, e.g. as a result of ingesting a bird.

It is known to insert a deformable spacer in each slot of the rotor disk between the bottom of the slot and the inwardly-facing face of the blade root retained in said slot. For example, French patent No. 2 841 609 illustrates a spacer comprising metal portions and portions made of semi-rigid elastomer. The shape of that spacer serves to accommodate movements of the root of a blade on the occurrence of an above-mentioned critical event. Under such circumstances, the fan blade pivots under the impact, with the blade root consequently pivoting in the slot in the disk. In addition to being subjected to a pivoting movement, the blade is also subjected to a plunging movement forwards and then rearwards, as a reaction. The front, central, and rear portions of the blade are subjected to twisting movements and to axial plunging movements of differing amplitudes for each of the portions.

When a blade is made of a composite material comprising a weave that is woven in three dimensions (referred to below as "3D woven") such impacts run the risk of the blade root cracking and can lead to it breaking, and consequently to the complete loss of the fan blade.

The invention proposes a novel type of spacer of shape that is defined to reduce the impact in the event of contact between the blade and the slot, to absorb a portion of the energy generated by the impact, and to reduce the risk of the blade being damaged.

OBJECTS AND SUMMARY OF THE INVENTION

To this end, the invention firstly provides a fan rotor comprising a disk with slots in its periphery and respective blades attached to said rotor, each blade including a blade root engaged in a corresponding slot, and each slot containing an elongate spacer interposed between the blade root and the bottom of the slot, wherein said spacer is made of an elastically deformable material, and wherein at least one longitudinal segment of said spacer presents a transverse profile of arcuate shape to define two lateral zones in contact with corresponding lateral zones of a blade root and spaced apart from the bottom of the slot, together with the corresponding central zone of the bottom of the slot.

According to an advantageous characteristic, the central zone of the segment is spaced apart from the corresponding central zone of the blade root. In other words, a small gap remains between the central zone of the spacer segment and the facing central zone of the blade root.

According to another advantageous characteristic, the spacer is constituted by a plurality of the segments interconnected by narrower junctions.

According to another advantageous characteristic, the spacer has a wave profile in its own longitudinal direction.

More precisely, said spacer can present longitudinally a central region in contact with the bottom of the slot and two end regions (longitudinally on either side of the central region) that are in contact with the blade root.

In addition, in normal operation, the section of the spacer is matched to the shape of the surrounding parts (slot in the fan disk and fan blade), and mounting takes place with a small amount of stress between the blade root and the bottom of the slot. Thus, the blade root is pressed against its bearing surfaces, bearing against the bottom of the slot (in the central portion) and under the blade root against the lateral bearing surfaces thereof. The above-mentioned wave profile serves to optimize contacts between the ends and the center of the spacer, and also between the blade and the disk.

By virtue of its flexibility, the spacer tracks the combined twisting and plunging movement that occurs during a critical event. It is interposed so as to limit the impact between the blade root and the slot of the disk. In addition, the contact zone between the spacer and the underside of the blade root is of a curved shape so as to enable those two parts to slide relative to each other in the event of the blade pivoting.

The spacer is preferably subdivided into three sections that respond separately to the combined movements of the blade root, thus enabling the movements and the deformations specific to each of the portions of the blade root to be accompanied as well as possible.

A coating of the polyurethane film type or the like is placed on and/or under the spacer so as to dissipate a portion of the energy of an impact, and consequently limit any risk of the spacer breaking and of the blade root cracking.

Advantageously, the spacer is made of a single piece of elastic composite material, and preferably of a 3D-woven composite material.

The result is particularly advantageous when the blades themselves are made of a composite material of the same kind.

Naturally, the invention also provides a spacer for insertion in a slot in a fan rotor, the spacer being made of an elastically deformable material and that it includes at least one longitudinal segment presents a transverse profile of arcuate shape.

BRIEF DESCRIPTION OF THE DRAWINGS

The invention can be better understood and other advantages thereof appear more clearly in the light of the following description given purely by way of example and made with reference to the accompanying drawings, in which:

FIG. 1 is a general perspective view of a spacer for inserting between a blade root and the bottom of a slot defined in the periphery of a rotor disk;

FIG. 2 shows the same spacer in longitudinal section and in position between a blade root and the bottom of a slot;

FIG. 3 is a diagrammatic cross-section view showing the relative positions of the spacer and the blade root in a rotor disk slot, the section corresponding to line III-III in FIG. 1; and FIG. 4 is a view analogous to FIG. 3 showing the behavior of these elements during a critical event.

MORE DETAILED DESCRIPTION

In the drawings, there can be seen a spacer 11 for inserting in a slot 13 of a disk 15 of a fan rotor. Such a disk is shown in part only in FIGS. 2 to 4. The spacer 11 is constituted by a single block of elastically deformable material, and more particularly in this example by a block of conventional 3D-woven composite material. The three-dimensional weave defining the core of the part is itself coated in resin.

As shown, the spacer includes at least one longitudinal segment transverse profile of arcuate shape. In the example shown, three segments 17*a*, 17*b*, and 17*c* of this kind are provided (the number of such segments could be different), which segments are united by narrower junctions 18 of the same material, the segments and the junctions together forming a single part.

Such a spacer is designed to be inserted in a tangential slot 13 formed in the periphery of the rotor disk 15. In this example, the disk is a fan rotor disk having blades 20 attached thereto. Each blade has a blade root 21 engaged in a corresponding slot 13. A spacer of the kind shown in FIGS. 1 to 3 is received in each slot 13 by being interposed between the blade root 21 and the bottom 13*a* of the slot 13.

As mentioned above, the spacer 11 is preferably made of 3D-woven composite material. More generally, the spacer is made of a material that is elastically deformable.

According to an important characteristic of the invention, the or each longitudinal segment 17*a*-17*c* of the spacer presents a transverse profile of arcuate shape so as to define two lateral zones 25*a*, 25*b* in contact with corresponding lateral zones 26*a*, 26*b* of the root of the blade 20, while being spaced apart from the bottom of the slot. Furthermore, a central zone 29 of the spacer segment is situated facing the corresponding central zone 30 of the bottom of the slot. This central zone of the spacer segment may be in contact with the bottom of the slot, as can be seen in FIG. 3.

Furthermore, the central zone of said segment may be spaced apart from the corresponding central zone of the blade root, leaving a small gap 32 between them.

As can be seen in FIG. 2, the spacer 11 has an undulating wave profile in its longitudinal direction. In the example shown, the spacer presents a longitudinally central region 11*a* in contact with the bottom of the slot, and two end regions 11*b* in contact with the blade root, but placed apart from the bottom of the slot. As shown in FIG. 2, the spacer is mounted under stress between the blade root and the bottom of the slot, such that its longitudinal curvature between the center and the ends is less than when in the non-stressed state, prior to mounting.

A coating of the polyurethane film type or the like is placed on and/or under the spacer. In the event of an incident, this enables a portion of the energy of the impact to be dissipated, and consequently enables the risk of the spacer breaking or of the blade root cracking to be limited.

As mentioned above, this type of spacer is well adapted to maintaining a blade of 3D-woven composite material in its slot, at rest or in normal operation.

Oblong holes 35 are also formed in the central zones of at least some of the segments, in order to further increase the flexibility and the deformability of various portions of the spacer. As can be seen in FIG. 3, the spacer is of a shape that is complementary to the conventional shape of the blade root, which shape serves to optimize contacts between the ends and the center of the blade and also serves to optimize contacts between the blade root and the walls of the slot. It should be observed that the spacer segments also present two narrow portions 36 between the lateral portions in contact with the blade root and the middle portion facing the bottom of the slot.

In addition, each junction 18 interconnecting two adjacent segments 17*a*-17*c* is situated substantially in line with and continuing from the central zones of the two segments that it unites. Furthermore, said junction presents a transverse profile that is substantially identical to that of the central zone of an above-mentioned segment.

Thus, the proposed solution that consists in giving an appropriate shape to the spacer and preferably in making it out of a flexible material that is identical to the material of the composite blade serves to eliminate any risk of the blade root cracking.

The prestress on mounting serves to press the blade root firmly against its bearing surfaces, by bearing against the bottom of the slot in the disk.

The wave shape of the spacer in the axial direction serves to optimize contacts between the ends and the center of the spacer and also between the blade and the disk.

As shown in FIG. 4, because the spacer is flexible, it tracks the combined twisting and plunging movement of the blade root on the occurrence of a critical event. The spacer is interposed so as to limit the impact between the blade root and the slot of the disk. Furthermore, the contacting zone between the spacer and the underside of the blade root is of a curved shape, thereby enabling these two parts to slide relative to each other in the event of a large amount of pivoting.

The three segments of the spacer react separately to the movement of the blade, thus enabling the movement of each of the portions of the blade root to be accompanied as well as possible.

What is claimed is:

1. A fan rotor comprising:

a disk with slots in its periphery and respective blades attached to said rotor, each blade including a blade root engaged in a corresponding slot, and each slot containing an elongate spacer interposed between the blade root and a bottom of the slot, wherein said spacer is made of an elastically deformable material, wherein at least one longitudinal segment of said spacer presents a transverse profile of arcuate shape to define two lateral zones in contact with corresponding lateral zones of the blade root and spaced apart from the bottom of the slot, and a central zone facing a corresponding central zone of the bottom of the slot, wherein said spacer presents a wave profile in its longitudinal direction, wherein said spacer presents, longitudinally, a central region only in contact with the bottom of the slot and two end regions only in contact with the blade root, wherein ends of the spacer are the highest points of said spacer in said transverse profile, and wherein, in said transverse profile, said lateral zones of said spacer are defined between a respective end of said spacer and said central zone.

2. A spacer for insertion in a slot in a fan rotor, the spacer being made of an elastically deformable material and including at least one longitudinal segment presenting a transverse profile of arcuate shape to define two lateral zones spaced apart from a bottom of the slot, and a central zone provided between the two lateral zones, wherein the spacer has a wave profile in its longitudinal direction, wherein the spacer presents, longitudinally, a central region only in contact with the bottom of the slot and two end regions disposed higher than the central region, wherein ends of said spacer are the highest points of said spacer in said transverse profile, and wherein, in said transverse profile, said lateral zones of said spacer are defined between a respective end of said spacer and said central zone.

* * * * *